US007631445B2

(12) United States Patent
Harrell

(10) Patent No.: US 7,631,445 B2
(45) Date of Patent: Dec. 15, 2009

(54) UNDERWATER DREDGING SYSTEM

(75) Inventor: Samuel J. Harrell, Carleton, MI (US)

(73) Assignee: Raymond E. Bergeron, Trenton, MI (US)

( * ) Notice: Subject to any disclaimer, the term of this patent is extended or adjusted under 35 U.S.C. 154(b) by 465 days.

(21) Appl. No.: 11/457,521

(22) Filed: Jul. 14, 2006

(65) Prior Publication Data

US 2008/0010869 A1 Jan. 17, 2008

(51) Int. Cl.
*E02F 5/02* (2006.01)
*G01F 1/00* (2006.01)
*E02F 3/00* (2006.01)

(52) U.S. Cl. ..... 37/348; 37/309; 37/341

(58) Field of Classification Search ..... 37/348, 37/382, 414, 309, 312, 341; 701/50; 414/699
See application file for complete search history.

(56) References Cited

U.S. PATENT DOCUMENTS 4,726,682 A * 2/1988 Harms et al. ..... 356/622
4,888,890 A * 12/1989 Studebaker et al. ..... 37/348
4,999,816 A * 3/1991 Dale et al. ..... 367/4
5,559,725 A * 9/1996 Nielson et al. ..... 700/302
5,682,311 A * 10/1997 Clark ..... 701/50
5,768,810 A * 6/1998 Ahn ..... 37/348
6,131,061 A * 10/2000 DenBraber et al. ..... 701/50
6,418,364 B1 * 7/2002 Kalafut et al. ..... 701/50
6,691,437 B1 * 2/2004 Yost et al. ..... 37/348
6,732,458 B2 * 5/2004 Kurenuma et al. ..... 37/348
6,934,616 B2 * 8/2005 Colburn et al. ..... 701/50
6,934,629 B1 * 8/2005 Chisholm et al. ..... 701/213
7,007,415 B2 * 3/2006 Koch ..... 37/348
7,010,873 B2 * 3/2006 Kinoshita et al. ..... 37/352
2006/0230645 A1 * 10/2006 McCain ..... 37/348
2006/0265914 A1 * 11/2006 Gudat ..... 37/348
2008/0000111 A1 * 1/2008 Green ..... 37/348

* cited by examiner

*Primary Examiner*—Thomas B Will
*Assistant Examiner*—Abigail A Risic
(74) *Attorney, Agent, or Firm*—Gifford, Krass, Sprinkle, Anderson & Citkowski, P.C.

(57) ABSTRACT

A system for use in conjunction with an underwater dredging apparatus having a power shovel with a bucket connected to a power housing by two articulated manipulator arms. The articulation of the manipulator arms relative to each other as well as one manipulator arm relative to the power housing controls both the horizontal position of the bucket as well as the vertical depth of the bucket. The system includes a data processor, a depth sensor which is attached to one manipulator arm at a predetermined position, as well as angle sensors which provide output signals of the relative angle of the manipulator arms relative to each other as well as relative to the power housing. The data processor is programmed to calculate the vertical depth of the bucket as a function of the depth sensor as well as the angle sensors. Once the bucket depth is calculated, the processor displays the bucket depth on a video display.

6 Claims, 2 Drawing Sheets

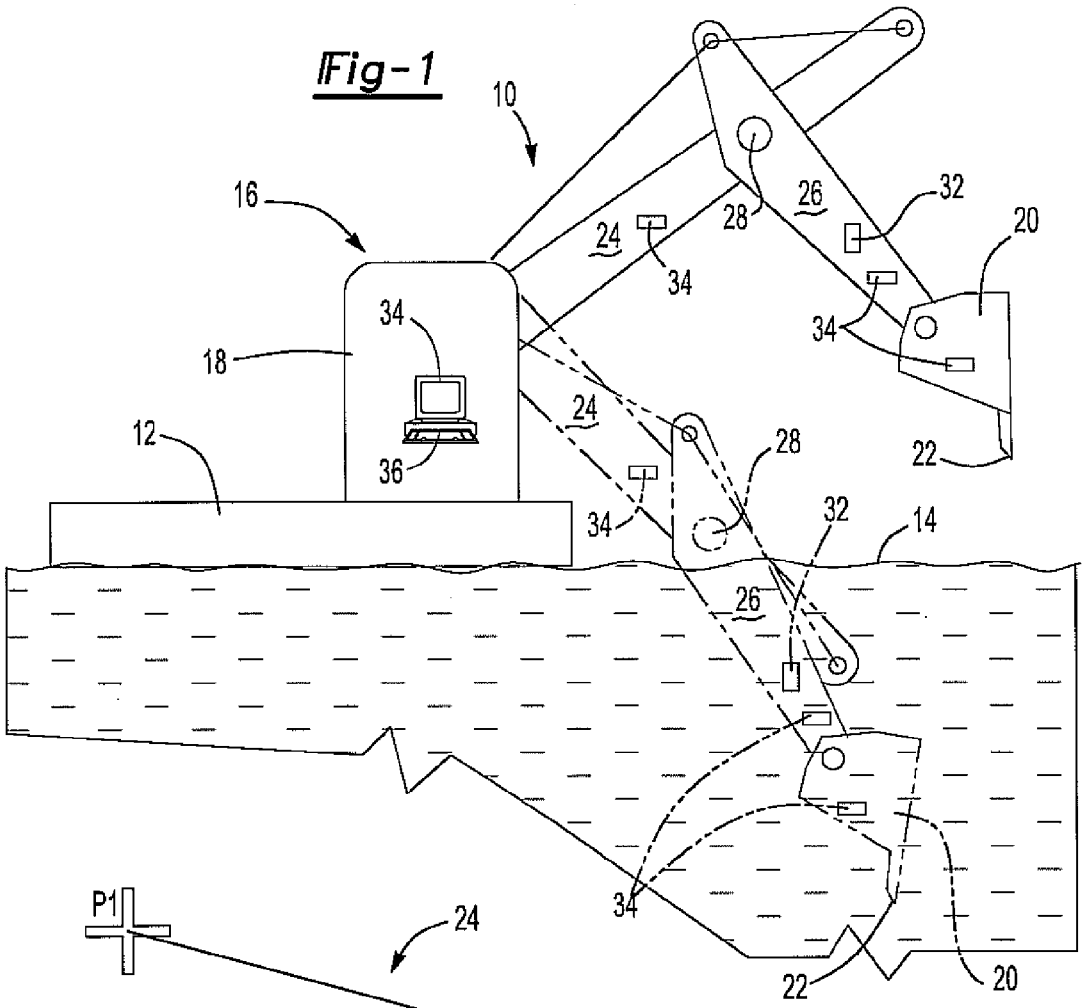
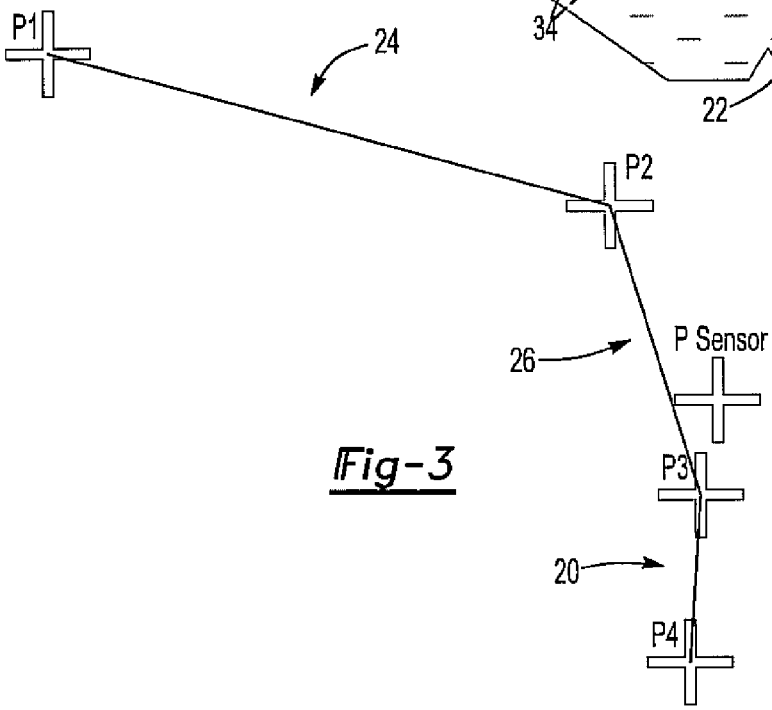
Fig-3

UNDERWATER DREDGING SYSTEM

BACKGROUND OF THE INVENTION

I. Field of the Invention

The present invention relates generally to underwater dredging and, more particularly, to a system and method for determining the depth of a bucket of the dredging system.

II. Description of Related Art

It is oftentimes necessary to dredge the bottom of a water body, such as a river, lake or the like. For example, in some situations an environmentally dangerous material may be spilled into the water body which must be removed for environmental reasons. In still other circumstances, dredging is conducted merely to increase the depth of the water body.

In order to perform the dredging operation, a power shovel is typically mounted on a barge and the barge is then moved to the desired location on the water body for the dredging operation. In such cases, the horizontal position of the barge can be easily, rapidly and accurately obtained using a GPS system.

During a dredging operation, it is important that the depth of the dredging operation be controlled as accurately as possible or at least within a preset range. For example, in the event that the dredging operation is conducted to remove an environmental hazard at the bottom of the water body, it is important that a sufficient amount of the bottom of the water body be removed in order to ensure the complete or near-complete removal of the environmental hazard.

Conversely, it is also desirable not to dredge the water body more than a specified depth due to the relatively high cost of the dredging operation. This is also particularly true where the dredging operation is conducted to remove an environmental hazard since the removed soil oftentimes must be transported to a special biohazard dump site. Such dump sites typically charge rates tied to the weight of the soil so that the removal of too much soil from the bottom of the water body increases the cost of the disposal of the removed soil.

There are different types of power shovels. For example, in one type of power shovel, a clamshell bucket is suspended on a cable which is positioned by an elevated crane. In this type of power shovel, it is relatively straightforward to determine the vertical position of the bucket within the water body by simply placing a pressure sensor at a predetermined position on the cable above the bucket. Since the vertical spacing between the sensor and the bucket remains constant, the depth of the bucket may be easily determined by simply determining the depth of the sensor and adding the spacing between the sensor and the bucket to that sensor depth.

In other types of power shovels, the power shovel includes a power housing having two articulated manipulator arms extending outwardly from the housing. One end of one arm is coupled to the housing while a bucket is mounted to the free end of the other arm. With this type of power shovel, the position of the bucket, both horizontally as well as vertically, varies with the angular position of the manipulator arms relative to both the power housing as well as each other.

Unlike the previously known cable suspended clamshell buckets, it is not possible to determine the vertical position of the bucket by simply placing a pressure sensor on the manipulator arm above the bucket since the vertical spacing between the sensor and the bucket will vary as a function of the angular position of the manipulator arms. For example, if the outer manipulator arm, i.e. the manipulator arm having the bucket at its free end, is extended outwardly in a generally horizontal direction, the vertical spacing between the sensor and the bucket is relatively small. Conversely, if the outer manipulator arm is generally vertically oriented, then the spacing between the depth sensor and the bucket will be relatively large. Consequently, there are no previously known systems for accurately determining the depth of the power bucket for a power shovel of the type having two or more articulated manipulator arms.

SUMMARY OF THE PRESENT INVENTION

The present invention provides a system for determining the underwater depth of the bucket for a power shovel of the type having two or more manipulator arms for positioning the power bucket.

In brief, the system of the present invention is designed for use with an underwater dredging apparatus having a power shovel with a power housing, a power bucket and two manipulator arms which are articulated relative to each other. One end of the inner arm is coupled to the power housing while a bucket is secured to the free end of the outer manipulator arm. The angular position of the manipulator arms relative to each other, as well as the inner manipulator arm relative to the power housing, is controlled by the operator of the dredging apparatus.

A depth sensor, such as a pressure sensor, is attached to the outer manipulator arm at a predetermined position relative to the bucket. Similarly, an angle sensor, such as an inclinometer, is also attached to each manipulator arm as well as the bucket. The angle sensors thus produce output signals representative of the relative angular position of the manipulator arms as well as the position of the bucket.

The output signals from both the depth sensor as well as the angle sensors are then coupled as input signals to a data processor in the power house. The data processor may comprise, for example, a laptop computer.

The data processor is then programmed to calculate the depth of the cutting edge of the bucket as a function of the sensor output signals and angular sensor output signals. Once the depth of the cutting edge of the bucket is determined, the data processor displays the depth of the bucket cutting edge on a video display.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a side diagrammatic view illustrating a preferred embodiment of the present invention;

FIG. 3 is a diagrammatic view illustrating the operation of the present invention.

DETAILED DESCRIPTION OF A PREFERRED EMBODIMENT OF THE PRESENT INVENTION

Figure 2:
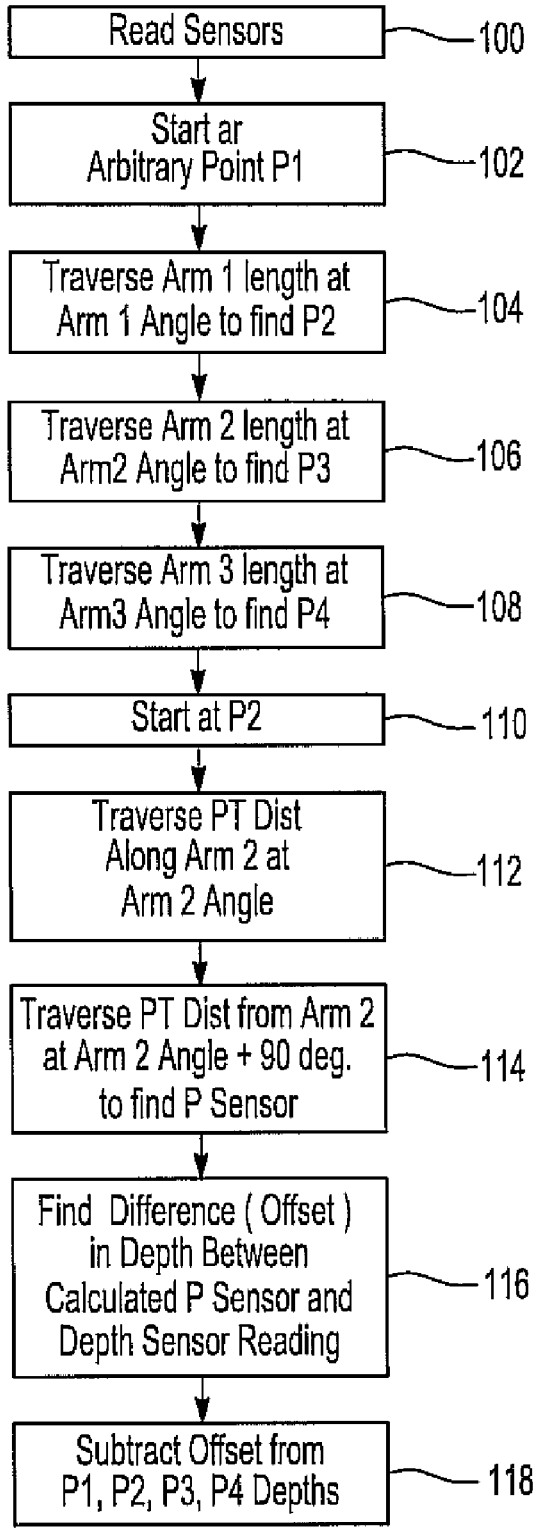
FIG. 2 is a flowchart illustrating the operation of the present invention.

With reference first to FIG. 1, a typical underwater dredging apparatus 10 is illustrated. The dredging apparatus includes a barge 12 which floats on a body of water 14. A power shovel 16 is then supported on top of the barge 12.

The power shovel 16 includes a power housing 18, a bucket 20 having a cutting edge 22, and at least two manipulator arms 24 and 26 which connect the bucket 20 to the power housing 18. The inner manipulator arm 24 is articulately coupled to the power housing 18 and the arms 24 and 26 are articulately coupled together at a joint 28. Similarly, the bucket 20 is articulately coupled to the free or outer end of the manipulator arm 26 in order to control the position of the cutting edge 22 of the bucket 20. An operator in the power housing 18 controls the position of the manipulator arms 24 and 26 as well as the position of the bucket 20 and thus controls the depth of the bucket cutting edge 22.

Although the power shovel 16 is illustrated in FIG. 1 as having only two manipulator arms 24 and 26, it will be understood that the power shovel 16 may have three or even more manipulator arms articulated together without deviation from either the spirit or scope of the invention.

Still referring to FIG. 1, a depth sensor 32 is mounted to the outer manipulator arm 26 at a predetermined position relative to the bucket 20. The depth sensor 32 is preferably a pressure sensor although other types of depth sensors may be used without deviation from either the spirit or scope of the invention.

An angle sensor 34, such as an inclinometer, is mounted on each articulator arm 24 and 26 as well as the bucket 20. These angle sensors 34 provide an output signal representative of the angular position of the arms 24 and 26 as well as the bucket 20. Other types of angle sensors, such as a rotary angle sensor, may be used without deviation from the spirit or scope of the invention.

The output signals from the depth sensor 32 as well as the angle sensors 34 are coupled as input signals to a data processor 36 in the power house 18. The data processor 36 may comprise, for example, a laptop computer and includes a video display 38 visible to the operator of the power shovel 16.

With reference now to FIG. 3, a mathematical representation of the manipulator arms 24 and 26 as well as the bucket 20 is illustrated. Point P1 represents an arbitrarily selected point on the first manipulator arm 24 typically at or near the power house 18. Point P2 represents the articulated connection between the arms 24 and 26. Similarly, point P3 represents the articulated connection between the arm 26 and the bucket 20 while point P4 represents the cutting edge of the bucket 20. The point PSensor represents the position of the depth sensor 32 on the manipulator arm 26.

The data processor 36 is programmed to calculate the vertical distance between point P1 and point P4 which, together with the calculation of the vertical depth of PSensor, provides an indication of the vertical depth of point P4 and thus of the position of the shovel cutting edge 22. In calculating the depth of point P4, the following values are known and fixed:

Arm1Length=length between P1 and P2

Arm2Length=distance between point P2 and P3

Arm3Length=distance between point P3 and P4

PTDistAlongArm2=distance between point P2 and PSensor along line P2-P3

PTDistFromArm2=lateral offset of point PSensor from line P2-P3

In addition to the fixed values, the following measured values are also provided to the data processor 36:

Arm1Angle=angle of the manipulator arm 24

Arm2Angle=angle of manipulator arm 26

Arm3Angle=angle of the bucket

Depth Sensor Reading

With reference now to FIG. 2, an exemplary flowchart illustrating the operation of the present invention, and in particular the calculation of the vertical depth of the bucket cutting edge 22 (P4), is illustrated. At step 100, the processor 36 reads all of the sensors, i.e. the angle sensors and the depth sensor. Step 100 then proceeds to step 102.

At step 102, the processor begins at the arbitrary point P1 and then proceeds to step 104 and traverses the length of the first manipulator arm 24 Arm1Length at the angle Arm1Angle to find the vertical position of point P2. Step 104 then proceeds to step 106.

At step 106, the data processor 36 traverses the length of the second manipulator arm 26 Arm2Length at the angle Arm2Angle to find the vertical position of point P3. Step 106 then proceeds to step 108. Step 108 then traverses the length of the bucket 20 between its pivotal connection P3 with the manipulator arm 26 and the cutting edge 22 at point P4 by traversing Arm3Length at Arm3Angle thus calculating the vertical position of point P4 relative to point P1. At the conclusion of step 108, all of the positions of the manipulator arms 24 and 26 as well as the bucket 20 are determined. Step 108 then proceeds to step 110.

At step 110, the processor 36 determines the position of the sensor PSensor by starting at point P2. Step 110 then proceeds to step 112 in which the processor traverses along the distance PTDistAlongArm2 at Arm2Angle to determine the position of the sensor PSensor along the axis connecting points P2-P3. Step 112 then proceeds to step 114.

At step 114, the processor 36 traverses distance P at Arm2Angle plus 90 degrees to find the vertical position of the sensor PSensor. Step 114 then proceeds to step 116.

At step 116, the processor calculates the difference in depth between the calculated depth PSensor and the Depth sensor reading. Step 116 then proceeds to step 118 where the calculated offset is subtracted from points P1, P2, P3 and P4. The vertical depth of P4 as corrected by the offset is then displayed on the video monitor of the processor 36. Step 118 then branches back to step 100 where the above process is iteratively repeated.

It will, of course, be understood that the flowchart illustrated in FIG. 2 is merely exemplary of one way to determine the depth of the bucket cutting edge P4 from the sensor readings. Other calculation methods may alternatively be used without deviation from the spirit or scope of the invention.

From the foregoing, it can be seen that the present invention provides a novel way of determining the actual depth of the cutting edge of the power shovel having two or more manipulator arms. Having described my invention, however, many modifications thereto will become apparent to those skilled in the art to which it pertains without deviation from the spirit of the invention as defined by the scope of the appended claims.

I claim:

1. For use in conjunction with an underwater dredging apparatus having a power shovel with a power house, a bucket and at least two manipulator arms each having a known length and extending between the bucket and the power house which position the bucket, a system for determining the underwater depth of the bucket comprising:

a data processor, a depth sensor attached to one manipulator arm, said sensor providing an output signal representative of the depth of the sensor to said data processor, an angle sensor attached to each manipulator arm, said angle sensors providing an output signal representative of the angle of each manipulator arm, said data processor programmed to calculate the depth of the bucket as a function of said depth sensor, the lengths of said manipulator arms and said angle sensor outputs and without the need of an input from any sensor external to the dredging apparatus, and a video display operatively connected to said data processor which displays the depth of the bucket.

2. The invention as defined in claim 1 wherein said depth sensor comprises a pressure sensor.

3. The invention as defined in claim 1 wherein said data processor comprises a computer.

4. The invention as defined in claim 3 wherein said computer comprises a laptop computer and wherein said video display comprises a screen of said laptop computer.

5. The invention as defined in claim 1 and comprising an angle sensor connected to the bucket which generates an output signal representative of the angle of the bucket relative to one manipulator arm, said bucket angle sensor output being coupled as an input signal to said processor.

6. The invention as defined in claim 1 wherein each angle sensor comprises an inclinometer.

* * * * *

UNITED STATES PATENT AND TRADEMARK OFFICE

CERTIFICATE OF CORRECTION

PATENT NO. : 7,631,445 B2
APPLICATION NO. : 11/457521
DATED : December 15, 2009
INVENTOR(S) : Samuel J. Harrell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 619 days.

Signed and Sealed this

Second Day of November, 2010

David J. Kappos

David J. Kappos
*Director of the United States Patent and Trademark Office*